US010549943B2

(12) United States Patent
Uno et al.

(10) Patent No.: US 10,549,943 B2
(45) Date of Patent: Feb. 4, 2020

(54) PRINTED UNIT BLOCK ALIGNING DEVICE AND PRINTED UNIT BLOCK ALIGNING METHOD

(71) Applicant: Uno Seisakusho Co., Ltd., Kanagawa (JP)

(72) Inventors: Tadao Uno, Kanagawa (JP); Yosuke Uno, Kanagawa (JP)

(73) Assignee: UNO SEISAKUSHO CO., LTD., Kanagawa (JP)

( * ) Notice: Subject to any disclaimer, the term of this patent is extended or adjusted under 35 U.S.C. 154(b) by 0 days.

(21) Appl. No.: 15/680,840

(22) Filed: Aug. 18, 2017

(65) Prior Publication Data

US 2018/0002128 A1 Jan. 4, 2018

Related U.S. Application Data

(62) Division of application No. 14/891,832, filed as application No. PCT/JP2013/079750 on Nov. 1, 2013, now Pat. No. 9,771,234.

(51) Int. Cl.
*B65H 35/00* (2006.01)
*B26D 7/32* (2006.01)
(Continued)

(52) U.S. Cl.
CPC ..... *B65H 35/008* (2013.01); *B26D 7/0675* (2013.01); *B26D 7/32* (2013.01);
(Continued)

(58) Field of Classification Search
CPC ..... B65G 57/081; B26D 7/32; B26D 11/00; B65H 35/002; B65H 35/004; B65H 9/00
(Continued)

(56) References Cited

U.S. PATENT DOCUMENTS 4,283,902 A 8/1981 Giori
4,367,997 A * 1/1983 Schweingruber ..... B65H 29/66 198/408
(Continued)

FOREIGN PATENT DOCUMENTS

JP S 5391899 8/1978
JP 5-178520 7/1993
(Continued)

*Primary Examiner* — Ghassem Alie
*Assistant Examiner* — Nhat Chieu Q Do
(74) *Attorney, Agent, or Firm* — Muncy, Geissler, Olds & Lowe, P.C.

(57) ABSTRACT

A printed unit block aligning device includes a supporting element and an alignment transfer rail. The supporting element is opened and closed between a supporting position and a releasing position. The alignment transfer rail receives the group of the printed unit blocks dropped in response to move of the supporting element to the releasing position, aligns the printed unit blocks in each line unit block in a vertical direction, and feeds the printed unit blocks vertically at a constant speed using alignment transferring element. An electrical controlling element is provided that electrically controls timing of dropping the printed unit blocks from the supporting element onto the alignment transfer rail. While a speed of transfer of the horizontal feeding and transferring element are uniform for any imposition structure, the electrical controlling element controls timing of dropping the printed unit blocks in a manner that depends on the numbers of layers in each vertical line in different imposition structures.

5 Claims, 10 Drawing Sheets

(51) Int. Cl.

| | |
|---|---|
| ***B26D 11/00*** | (2006.01) |
| ***B65H 35/02*** | (2006.01) |
| ***B65H 35/04*** | (2006.01) |
| ***B26D 9/00*** | (2006.01) |
| ***B26D 7/06*** | (2006.01) |
| ***B65H 9/00*** | (2006.01) |

(52) U.S. Cl.
CPC ..... *B26D 9/00* (2013.01); *B26D 11/00* (2013.01); *B65H 9/00* (2013.01); *B65H 35/02* (2013.01); *B65H 35/04* (2013.01); *B26D 2007/322* (2013.01); *B26D 2011/005* (2013.01); *B65H 2701/1912* (2013.01)

(58) Field of Classification Search
USPC ..... 83/404.1, 155–155.1; 414/788–796.9
See application file for complete search history.

(56) References Cited

U.S. PATENT DOCUMENTS

| | | | | |
|---|---|---|---|---|
| 4,710,089 | A | 12/1987 | Schneider | |
| 5,507,615 | A * | 4/1996 | Uno ..... | B65G 57/035 198/431 |

FOREIGN PATENT DOCUMENTS

| | | |
|---|---|---|
| JP | 6-9141 | 1/1994 |
| JP | 06190790 A | 7/1994 |
| JP | 7-102519 | 11/1995 |
| JP | 2011-518738 | 6/2011 |

* cited by examiner

PRINTED UNIT BLOCK ALIGNING DEVICE AND PRINTED UNIT BLOCK ALIGNING METHOD

CROSS REFERENCE TO RELATED APPLICATIONS

This application is a Divisional of co-pending application Ser. No. 14/891,832, filed on Nov. 17, 2015, which is a U.S. National Stage of International Application No. PCT/JP2013/079750, filed on Nov. 1, 2013, for which priority is claimed under 35 U.S.C. § 120; the entire contents of all of which are hereby incorporated by reference.

TECHNICAL FIELD

This invention relates to a printed unit block aligning device that aligns printed unit blocks in order of serial number such as blocks of bank bills or postcards given serial numbers, each of which includes 100 sheets from 1 to 100 or from 101 to 200, for example.

BACKGROUND ART

If 10 unit blocks each including a stack of 100 bank bills are to be stacked in order of serial number in an integrating step, for example, a step of aligning the unit blocks in numerical order should be performed before the integrating step. A conventional unit block aligning device responsible for this type of alignment is represented by patent literature 1, for example. In this unit block aligning device, a large sheet block including a stack of large sheets each given multiple prints in vertical lines and horizontal lines is cut into multiple line unit blocks, the multiple line unit blocks formed by the cutting are aligned in a large number of lines, each of all these lines is cut sequentially from the front end to form a large number of printed unit blocks, the resultant printed unit blocks are fed onto an alignment line and aligned in numerical order, and then supplied to the integrating step. In this device, aligning the unit blocks is extremely insufficient work and becomes an obstacle to efficiency increase in the integrating step. Additionally, a considerably large cutter is required to cut a large number of aligned line unit blocks at a time.

The invention of patent literature 2 filed by the applicant of this application has been suggested as a remedy for the aforementioned issue. According to the invention of patent literature 2, a printed unit block group in each of serial number groups is fed vertically and transferred and charged on an upper rail. As the upper rail moves to a releasing position, the charged printed unit block group in each of the serial number groups is dropped onto a lower rail group.

Next, the printed unit block group in each of the serial number groups dropped onto the lower rail is fed horizontally and transferred to supporting means collectively. Then, as the supporting means moves to a releasing position, the printed unit block group in each of the serial number groups is dropped onto an alignment transfer rail. Printed unit blocks are aligned in a vertical direction in order of serial number along the alignment transfer rail, fed vertically to an integrating step, and then taken out.

As a result, the printed unit block group is processed and aligned in each line unit cut out from a large sheet block.

The invention of patent literature 2 has a two-story structure with the upper rail and the lower rail group perpendicular to each other. The printed unit block group in each of the serial number groups is fed vertically and charged on the upper rail along a conveyor with a pusher provided on an upper part of the upper rail so as to extend parallel to the upper rail. As the upper rail moves to the releasing position, the charged printed unit block group is dropped onto the lower rail group. Then, the printed unit bock group in each of the serial number groups is fed horizontally along a conveyor with a pusher provided on a lower part of each lower rail so as to extend parallel to the lower rail and then supplied to an alignment line. In this way, work of producing a state where the printed unit block group in each of the serial number groups is aligned in a vertical direction along the alignment line and vertically feeding the printed unit block group to a subsequent step is carried out appropriately in limited space.

PRIOR ART LITERATURE

Patent Literature

Patent Literature 1: U.S. Pat. No. 4,283,902

Patent Literature 2: Publication of Examined Japanese Patent Application No. 7-102519

SUMMARY OF INVENTION

Problem to be Solved by Invention

The aforementioned structure of patent literature 2 achieves excellent effect in terms of realizing efficient and economical alignment in small space. However, this structure has several drawbacks recognized in the course of dropping from the lower rail onto the alignment transfer rail.

A first drawback is as follows: while dropping printed unit blocks in the same number of layers in each vertical line from the lower rail group does not cause troublesome issue, feeding printed unit blocks in different numbers of layers to the alignment transfer rail causes a problem in that a speed of transfer along the lower rail should be changed.

Specifically, it is assumed that a large sheet is changed from a sheet having an imposition structure with five layers in a vertical line to a sheet having an imposition structure with 10 layers in a vertical line, for example. In the case of the former sheet, subsequent five bundles may be supplied to the alignment transfer rail at a time when vacancy corresponding to five bundles opens up on the alignment transfer rail. Meanwhile, in the case of the latter sheet, a next bundle is to be supplied after vacancy corresponding to 10 bundles opens up.

A speed of transfer along the alignment transfer rail should be constant under a constraint of a subsequent step. Thus, extensive work has conventionally been necessitated that involves exchange of a clutch or a gear of transferring means for transfer over the lower rail group.

Additionally, in such a system of changing gears, exchange gears should always be prepared in response to the number of layers of each line unit block. This involves large increase in parts cost.

A second drawback lies in that the supporting means of the conventional structure employs a side-open shutter structure that opens only in one direction and each printed unit block slides down on a shutter plate opened to a given angle to be dropped onto the alignment transfer rail. A speed of dropping each printed unit block is limited depending on the angle of opening of the shutter plate. This becomes a cause for operation loss.

Further, by making each printed unit block slide down, the printed unit block is dropped onto irregular positions on a surface of the alignment transfer rail. This becomes a cause for a failure of having a block or a sheet of paper get caught in a gap of the device.

This invention has been made to solve the aforementioned problems. It is an object of this invention to achieve higher efficiency and higher accuracy of alignment work in a printed unit block aligning device.

Means of Solving Problem

This invention provides a printed unit block aligning device as follows in order to solve the aforementioned problems.

The printed unit block aligning device cuts a large sheet with multiple prints having an imposition structure in vertical lines and horizontal lines into printed unit blocks, aligns the printed unit blocks, and transfers the printed unit blocks at a speed constant for any imposition structure to a subsequent step. The printed unit block aligning device includes primary cutting means that cuts a large sheet block including a stack of the large sheets into line unit blocks arranged side by side and secondary cutting means that cuts the line unit block formed by the cutting by the primary cutting means into printed unit blocks.

The printed unit block aligning device includes an upper rail that is opened and closed between a supporting position and a releasing position. The supporting position is a position where the printed unit blocks are charged in each line unit block by vertical feeding and transferring means that feeds a group of the printed unit blocks vertically. The printed unit block aligning device further includes a lower rail group arranged directly below the upper rail to be perpendicular to the upper rail. The lower rail group receives each of the printed unit blocks in a group in each line unit block dropped in response to move of the upper rail to the releasing position and feeds the group of the printed unit blocks using horizontal feeding and transferring means.

The printed unit block aligning device includes supporting means that is opened and closed between a supporting position and a releasing position. The supporting position is a position where the group of the printed unit blocks in each line unit block fed horizontally and transferred from the lower rail group is received. The printed unit block aligning device further includes an alignment transfer rail that receives the group of the printed unit blocks dropped in response to move of the supporting means to the releasing position, aligns the group of the printed unit blocks in each line unit block in a vertical direction, and feeds the group of the printed unit blocks vertically at a constant speed using alignment transferring means.

In the aforementioned structure, electrical controlling means is provided that electrically controls timing of dropping of the printed unit blocks from the supporting means onto the alignment transfer rail. While a speed of transfer of the horizontal feeding and transferring means is determined to be uniform for any imposition structure, the electrical controlling means controls timing of dropping of the printed unit blocks in a manner that depends on the numbers of layers in each vertical line in different imposition structures.

It is preferable that the speed of transfer of the horizontal feeding and transferring means be a speed unified under a condition of a minimum number of layers in each vertical line of an imposition structure with which the device is compatible.

The supporting means in the supporting position may support the printed unit block at opposite lateral sides of the printed unit block and the supporting means in the releasing position may release the opposite lateral sides from the support simultaneously to drop the printed unit block onto the alignment transfer rail.

The electrical controlling means may be configured so as to generate a given halt period in the horizontal feeding to control timing of dropping of the printed unit blocks by controlling a clutch brake provided to the horizontal feeding and transferring means.

This invention can also provide a printed unit block aligning method as follows.

According to the printed unit block aligning method, a large sheet with multiple prints having an imposition structure in vertical lines and horizontal lines is cut into printed unit blocks, the printed unit blocks are aligned, and then transferred at a speed constant for any imposition structure to a subsequent step. The method includes each of the following steps:

(S1) a primary cutting step of cutting a large sheet block including a stack of the large sheets into line unit blocks arranged side by side;

(S2) a secondary cutting step of cutting the line unit block into printed unit blocks;

(S3) a vertically feeding step of feeding a group of the printed unit blocks vertically and charging the printed unit blocks in each line unit block on an upper rail;

(S4) a horizontally feeding step of releasing the printed unit blocks from the upper rail, dropping the printed unit blocks onto a lower rail group perpendicular to the upper rail, receiving each of the printed unit blocks in a group in each line unit block, and feeding the group of the printed unit blocks horizontally; and (S5) an alignment transferring step of receiving the group of the printed unit blocks in each line unit block fed horizontally and transferred from the lower rail group with supporting means, releasing the supporting means and making an alignment transfer rail receive the group of the printed unit blocks, aligning the group of the printed unit blocks in each line unit block in a vertical direction, and feeding the group of the printed unit blocks vertically.

This invention is characterized in that in the aforementioned alignment transferring step, electrical controlling means is provided that electrically controls timing of dropping of the printed unit blocks from the supporting means onto the alignment transfer rail, and the electrical controlling means controls timing of dropping of the printed unit blocks in a manner that depends on the numbers of layers in each vertical line in different imposition structures while determining a speed of transfer in the horizontal feeding and transferring step to be uniform for any imposition structure.

In the aforementioned printed unit block aligning method, it is preferable that the speed of transfer in the horizontal feeding and transferring step be a speed unified under a condition of a minimum number of layers in each vertical line of an imposition structure with which a device is compatible.

The electrical controlling means may generate a given halt period in the horizontal feeding to control timing of dropping of the printed unit blocks by controlling a clutch brake provided to the horizontal feeding and transferring means.

The supporting means in a supporting position may support the printed unit block at opposite lateral sides of the printed unit block and the supporting means in a releasing position may release the opposite lateral sides from the support simultaneously to drop the printed unit block onto the alignment transfer rail.

Advantageous Effects of Invention

This invention having the aforementioned structure achieves the following advantageous effects.

A change gear mechanism for changing a speed of transfer of the lower rail for the horizontal feeding can be omitted. This facilitates compatibility with large sheets of a variety of imposition structures. This contributes to increase in production efficiency. This also achieves reduction in parts count, contributing to cost reduction.

A speed of transfer for the horizontal feeding is unified under a condition of a highest speed of transfer of the alignment transfer rail, specifically under a condition of a minimum number of layers in each line unit block. This achieves compatibility with a large sheet of a large number of layers.

An opening and closing shutter forming the supporting means with which the line unit block on a surface of the lower rail is dropped onto the alignment transfer rail is changed from a side-open structure to a center-open structure. This allows each printed unit block to be dropped at a maximum speed, thereby reducing operation loss. This further stabilizes a drop position, thereby avoiding a cause for a failure of having a block or a sheet of paper get caught in a gap of the device.

EMBODIMENT FOR CARRYING OUT INVENTION

Figure 1:
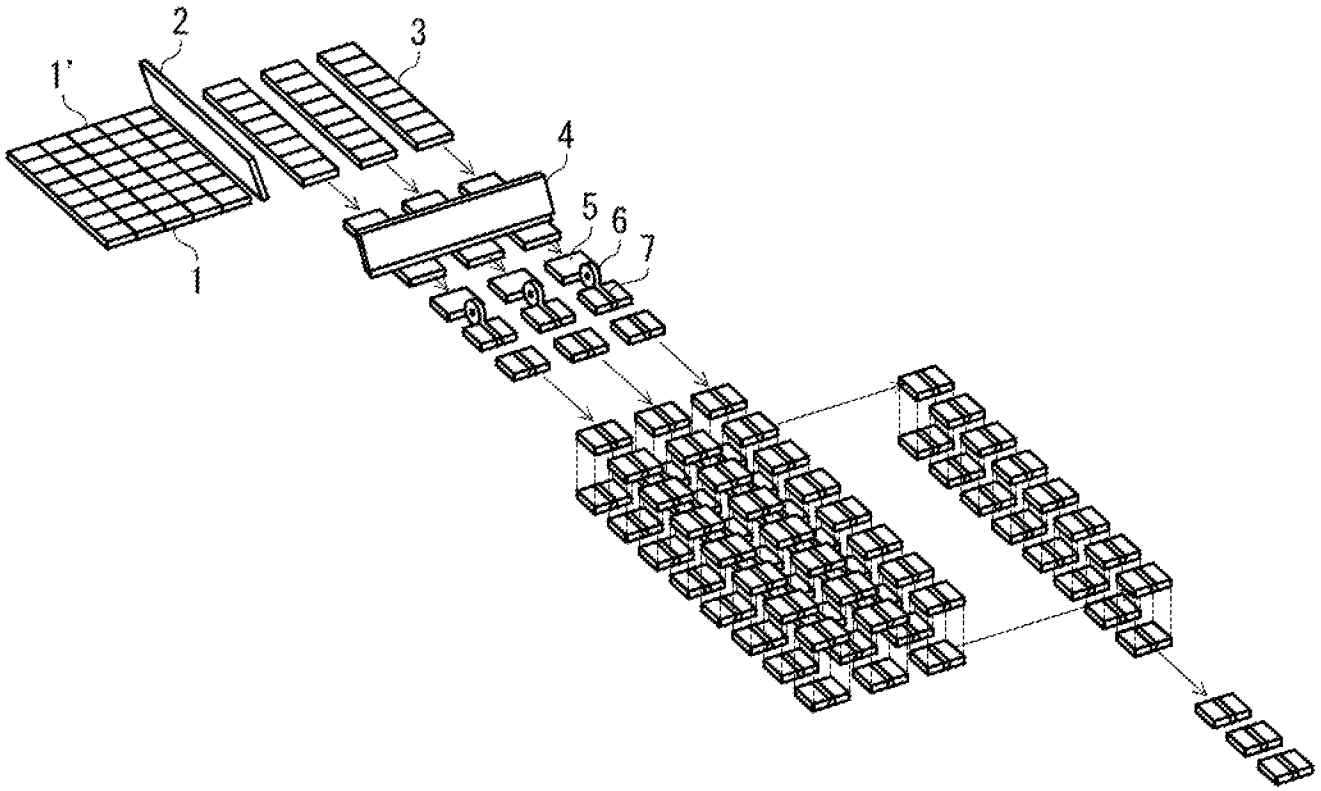
FIG. 1 is a perspective view explaining a procedure taken by a printed unit block aligning device of this invention.

An embodiment of this invention is described below based on an example shown in the drawings. This invention is not limited to the following embodiment.

Figure 2:
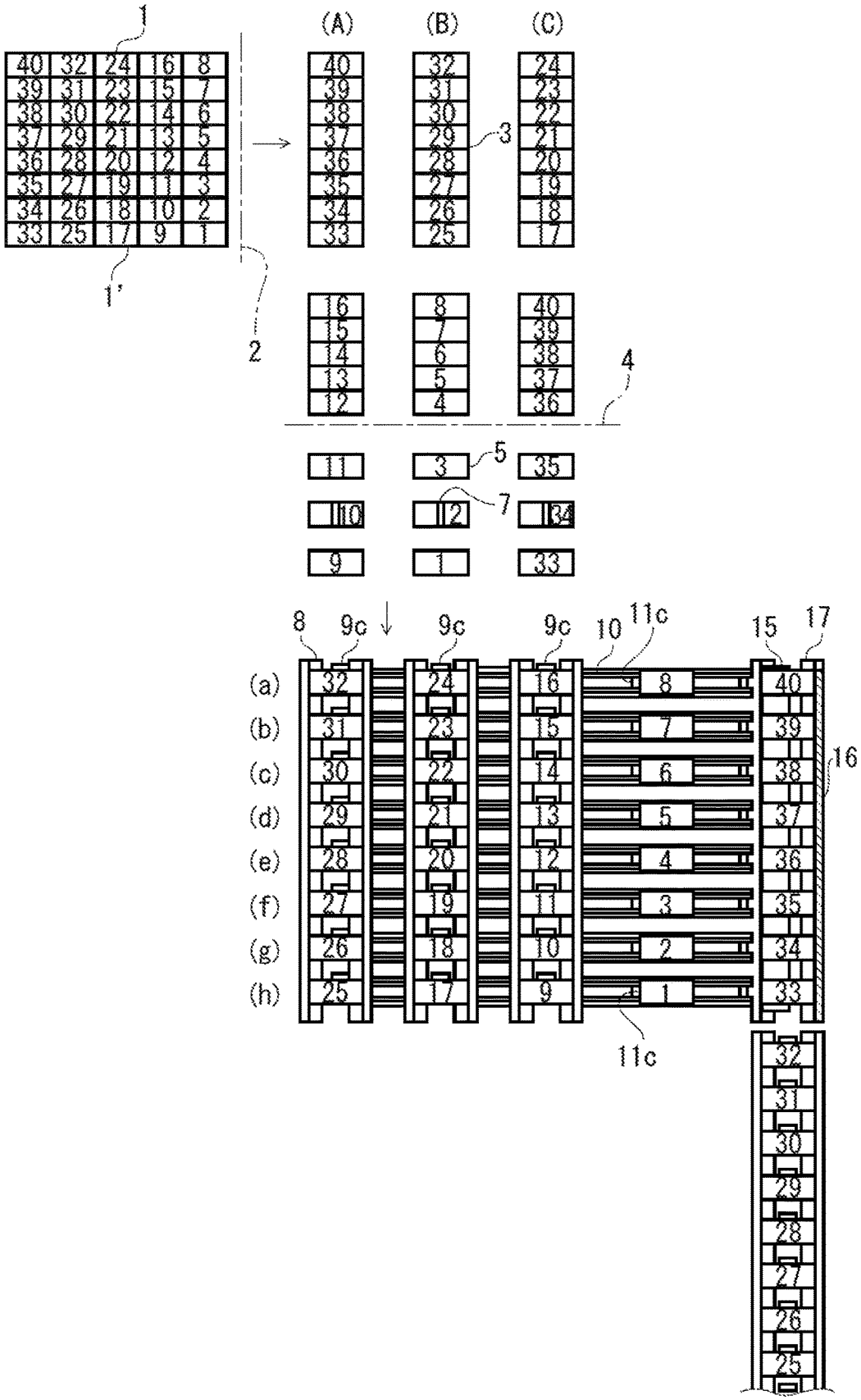
FIG. 2 is a plan view explaining this procedure.

FIGS. 1 and 2 show a unit block aligning device that aligns sheet blocks in units of 100 in numerical order such as blocks of bank bills, lottery tickets, or postcards, for example. The numerical order mentioned in this invention means stacking from a first position to a last position and is not limited to stacking according to particular indications such as numerical characters.

As an example, a large sheet 1 shown in FIGS. 1 and 2 is given multiple prints from No. 1 to No. 40 in vertical lines and horizontal lines and has an imposition structure with eight layers in each vertical line and five layers in each horizontal line. This numbering of vertical lines and horizontal lines in an imposition structure is applicable throughout this specification.

One hundred large sheets 1 are stacked to form a large sheet block 1'. Corresponding printed sides from printed sides in No. 1 to printed sides in No. 40 of the large sheet block 1' are stacked in a stacking direction in order of serial number. As an example, printed sides in No. 1 is given serial numbers from 1 to 100, printed sides in No. 2 is given serial numbers from 101 to 200, and printed sides in No. 3 is given serial numbers from 201 to 300.

First, the large sheet block 1' is subjected to a trimming step not shown in the drawings to cut an unnecessary edge. Then, the large sheet block 1' is cut sequentially into lines from a front line to a last line with a cutter 2 forming primary cutting means, thereby forming line unit blocks 3.

The line unit blocks 3 formed by the cutting are arranged side by side in three lines including a line A, a line B, and a line C. The line unit blocks 3 in the lines A, B, and C are each fed vertically and cut sequentially into printed units from a front end with a cutter 4 forming secondary cutting means, thereby forming printed unit blocks 5.

The printed unit blocks 5 in the lines A, B, and C formed by the cutting are each bound with a band 7 using binding means 6 to form a large number of printed unit blocks 5 each containing 100 sheets arranged in order of serial number. The printed unit blocks 5 are "fed vertically" onto an upper rail 8 and the printed unit blocks 5 in each of the line unit blocks 3 are charged on this rail 8.

In this example, the line unit blocks 3 are arranged in three lines. However, this invention can be implemented with any number of lines for vertical feeding.

Figure 3:
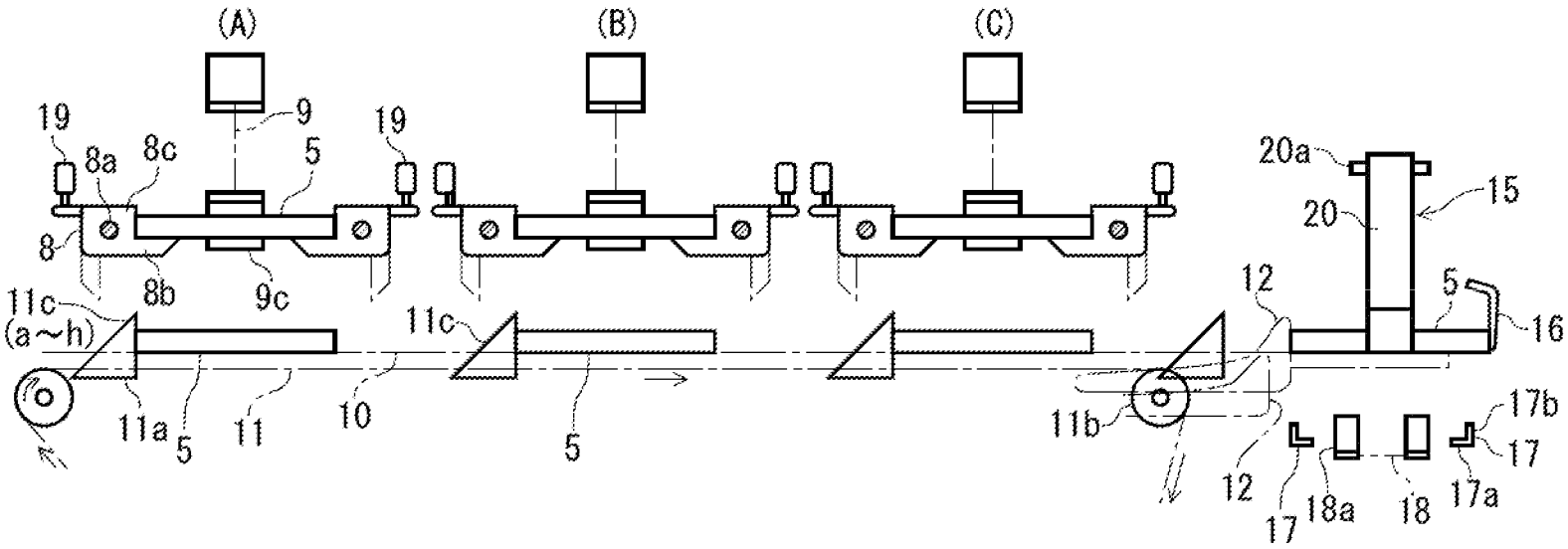
FIG. 3 is a front view of the unit block aligning device forming the aforementioned system.
Figure 4:
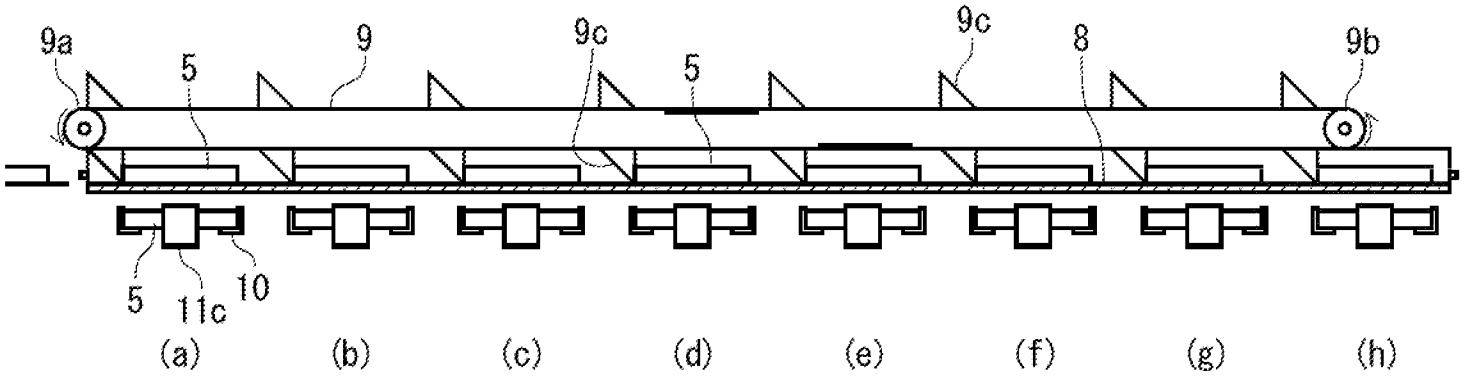
FIG. 4 is a side view of the unit block aligning device.

As shown in FIG. 3, the upper rail 8 is provided for each of the lines A, B, and C in a manner such that the upper rail 8 can be opened and closed between a supporting position where a group of the printed unit blocks 5 is supported and a releasing position where the group is released from the support. The upper rail 8 has bottom rulers 8*b* extending parallel that permit drop of the group of the printed unit blocks 5 when the group is released and side rulers 8*c* with which lateral sides of the printed unit block 5 are regulated. An endless conveyor 9 as vertical feeding and transferring means is arranged on an upper part of each rail 8 so as to extend parallel to this rail 8. As shown in FIG. 4, the endless conveyor 9 is stretched between a pulley 9*a* and a pulley 9*b* in a manner that allows the endless conveyor 9 to travel endlessly. The endless conveyor 9 has a large number of evenly spaced pushers 9*c* with which a rear end surface of each of the printed unit blocks 5 is pressed to carry these printed unit blocks 5 onto the upper rail 8 at given intervals.

Figure 5:
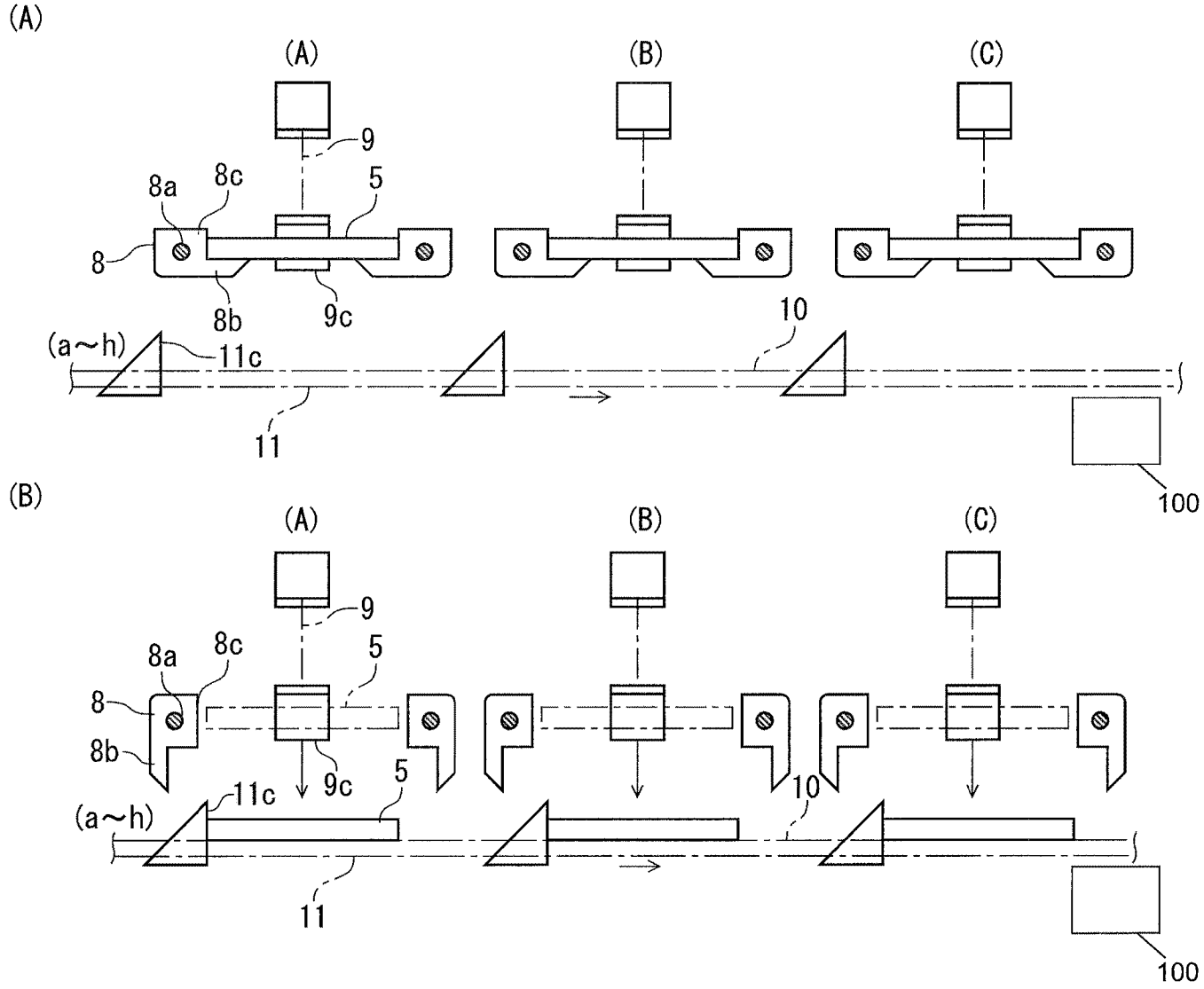
FIG. 5 explains how a printed unit block is dropped from an upper rail onto a lower rail forming the unit block aligning device: (A) is a front view showing a state where the upper rail is closed; and (B) is a front view showing a state where the upper rail is opened.
Figure 6:
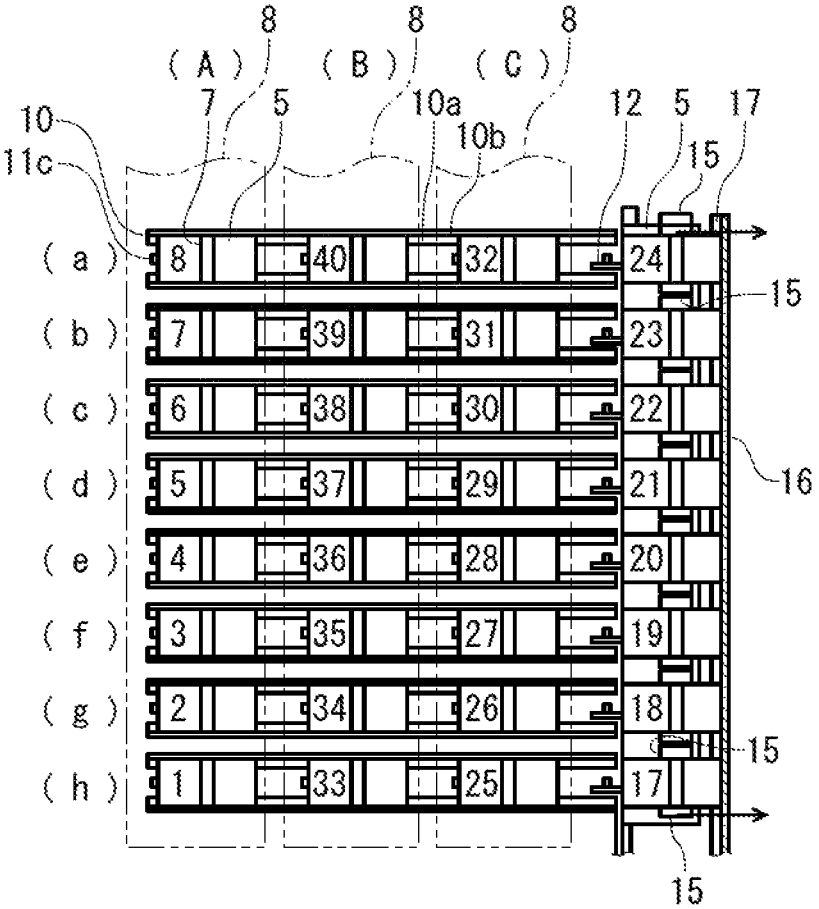
FIG. 6 is a plan view showing a lower rail group and an alignment transfer rail forming the unit block aligning device.

The endless conveyor 9 travels intermittently to transfer the printed unit blocks 5 one by one onto the bottom rulers 8*b* of the upper rail 8 with the pusher 9*c*, as shown in FIG. 5(A). If a group of the printed unit blocks 5 of a number corresponding to the line unit block 3 is charged on the corresponding upper rail 8, the upper rail 8 is opened, specifically the bottom rulers 8*b* rotate downward substantially 90 degrees about respective axes 8*a* to drop the group of the printed unit blocks 5 in each line unit block 3, as shown in FIG. 5(B). Groups of the printed unit blocks 5 are dropped in this way substantially simultaneously in the lines A and B. The upper rail 8 is opened and closed for example with an air cylinder 19 or a cam. Alternatively, the upper rail 8 may be opened and closed between the supporting position and the releasing position by being caused to advance and retreat horizontally.

The group of the printed unit blocks 5 dropped from the upper rail 8 is received by a lower rail 10 perpendicular to the upper rail 8. To facilitate understanding of the description of this example, the lower rail 10 includes lower rails 10 in eight layers a to h same as the number of layers (eight layers) of the group of the printed unit blocks 5 corresponding to each line unit block 3. However, in this invention, these numbers of layers are not always required to be the same.

Each lower rail 10 has bottom rulers 10*a* extending parallel to each other and side rulers 10*b* with which lateral sides of the printed unit block 5 are regulated. An endless conveyor 11 as horizontal feeding and transferring means is arranged along a lower part of each lower rail 10.

The conveyors 11 and the aforementioned conveyor 9 are arranged so as to be perpendicular to each other. The endless conveyors 11 are each stretched between a pulley 11*a* and a pulley 11*b* shown in FIG. 3 in a manner that allows the endless conveyor 11 to travel endlessly. The endless conveyors 11 each have transfer pushers 11*c*. As the endless conveyors 11 travel intermittently, groups of the printed unit blocks 5 received from the respective upper rails 8 in the lines A, B, and C are transferred with the transfer pushers 11*c* at given intervals in a horizontal direction along the lower rails 10. Specifically, as the endless conveyors 11 travel intermittently, the groups of the printed unit blocks 5 existing in the layers a to h are intermittently "fed horizontally" along the bottom rulers 10*a* of the lower rails 10 and transferred to supporting means 15 with the transfer pushers 11*c* while relative arrangements of these groups of the printed unit blocks 5 in the lines A, B, and C are maintained.

Figure 7:
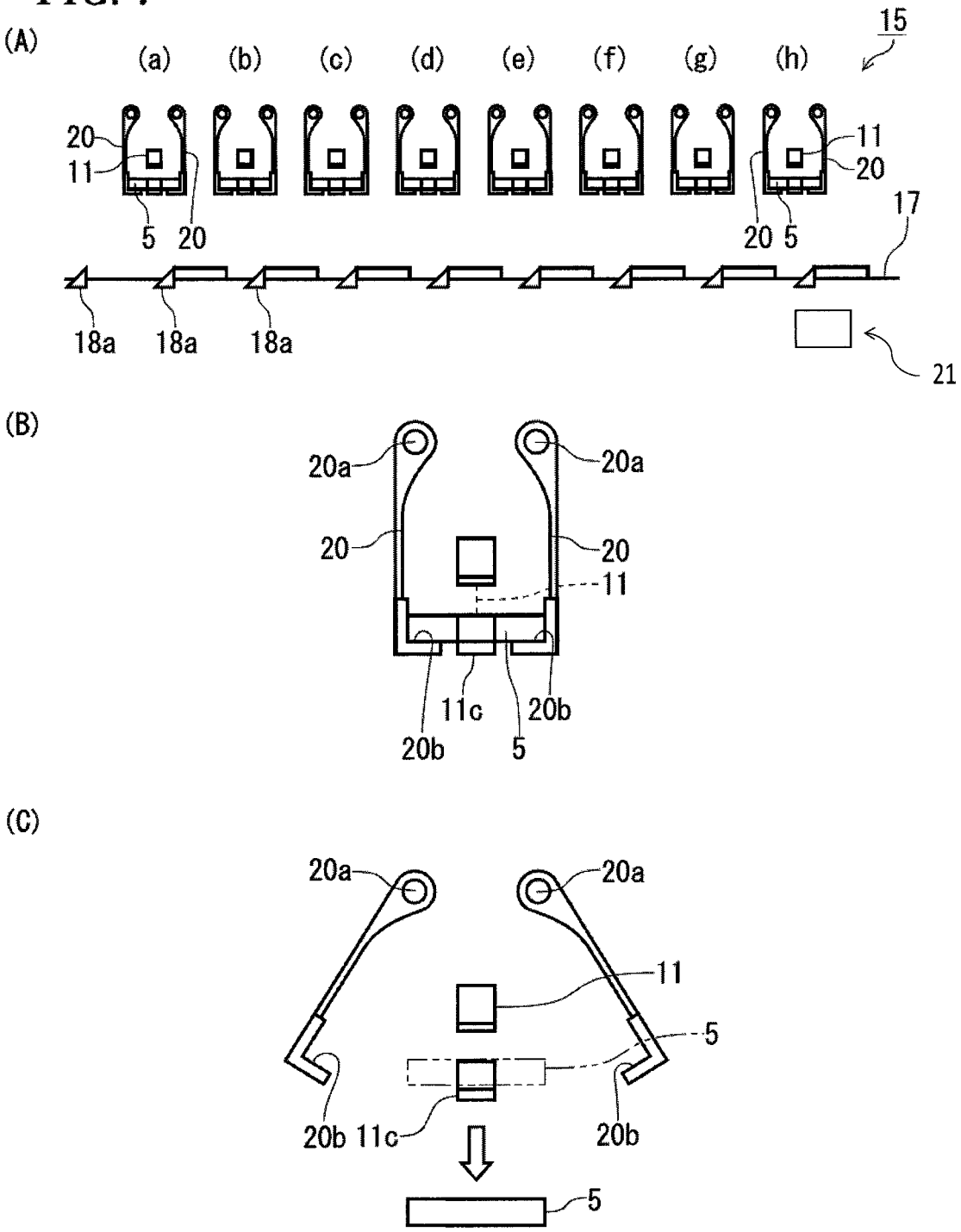
FIG. 7 is a side view explaining operation of supporting means: (i) shows the supporting means in its entirety; (ii) shows a supporting state; and (iii) shows a releasing state.

FIG. 7 is a side view of the supporting means 15 taken in a horizontal direction. The supporting means (15) of this invention includes supporting means (15) of a number same as the number of the horizontal feeding and transferring means arranged on the extension of the horizontal feeding and transferring means. Specifically, the supporting means 15 is configured to support the printed unit block 5 in each of the layers (a) to (h) with shutter portions 20, 20 capable of being opened and closed.

First, a group of the printed unit blocks 5 in the layers a to h to be transferred from the lower rails with the transfer pushers 11*c* is pushed toward the supporting means 15 at the ends the lower rails 10 while the aforementioned relative arrangements in the lines A, B, and C are maintained. Then, an assurance pusher 12 provided for the lower rail 10 in each of the layers a to h projects from a standby position indicated by virtual lines to a position indicated by solid lines shown in FIG. 3. This pushes the group of the unit blocks 5 further having been brought from the ends of the lower rails 10 onto the supporting means 15, thereby fixing the group of the unit blocks 5 at fixed positions on the supporting means 15. The group of the unit blocks 5 pushed into the supporting means 15 forms abutting contacts with front plates 16 to be kept at the fixed positions within the shutter portions 20.

As shown in FIGS. 7(*ii*) and (*iii*), each unit block 5 is placed at a supporting position that is a position on bottom rulers 20*b* of the shutter portions 20. If the shutter portions 20 are opened toward opposite sides about respective axes 20*a* thereafter, the printed unit block 5 is released from the support (placed at a releasing position) as clearly seen from the drawings, thereby dropping the group of the printed unit blocks 5 together.

The group of the dropped printed unit blocks 5 is received by an alignment transfer rail 17 (see FIG. 3) directly below the shutter portions 20. The alignment transfer rail 17 has bottom rulers 17*a* with which a group of the printed unit blocks 5 is supported and side rulers 17*b* with which lateral sides of the printed unit block 5 are regulated. An endless conveyor 18 as alignment transferring means is arranged along the alignment transfer rail 17. The endless conveyor 18 has pushers 18*a* with which the group of the printed unit blocks 5 received from the supporting means 15 is transferred in a vertical direction from the respective positions where the group of the printed unit blocks 5 is dropped along the alignment transfer rail 17. The endless conveyor 18 travels intermittently to align the group of the printed unit blocks 5 along the bottom rulers 17*a* of the transfer rail 17 with the pushers 18*a* of the endless conveyor 18 in numerical order, thereby transferring the group of the printed unit blocks 5 to a subsequent step (integrating step) intermittently.

The aforementioned operations are repeated to transfer a group of the printed unit blocks 5 cut out from the large sheet block 1' with multiple prints in vertical lines and horizontal lines to a subsequent step (integrating step) while aligning the group of the printed unit blocks 5 in order of serial number. In the integrating step, a printed unit block 5 of No. 2 is stacked on a printed unit block of No. 1 and a block of No. 3 is stacked on a block of No. 2 of FIG. 1, for example. In this way, integrated blocks each including 10 blocks from No. 1 to No. 10 are formed one after another.

The operation of the printed unit block aligning device of this invention is as described above. Meanwhile, there has been a conventional problem in that limitation has been imposed on imposition structure of the large sheet block 1.

Specifically, the large sheet block of the aforementioned example has a 40-up imposition with eight layers in each vertical line and five layers in each horizontal line. If a large sheet block of a different imposition is to be used, a change gear mechanism should be exchanged for changing the speed of the horizontal feeding and transferring means.

Figure 8:
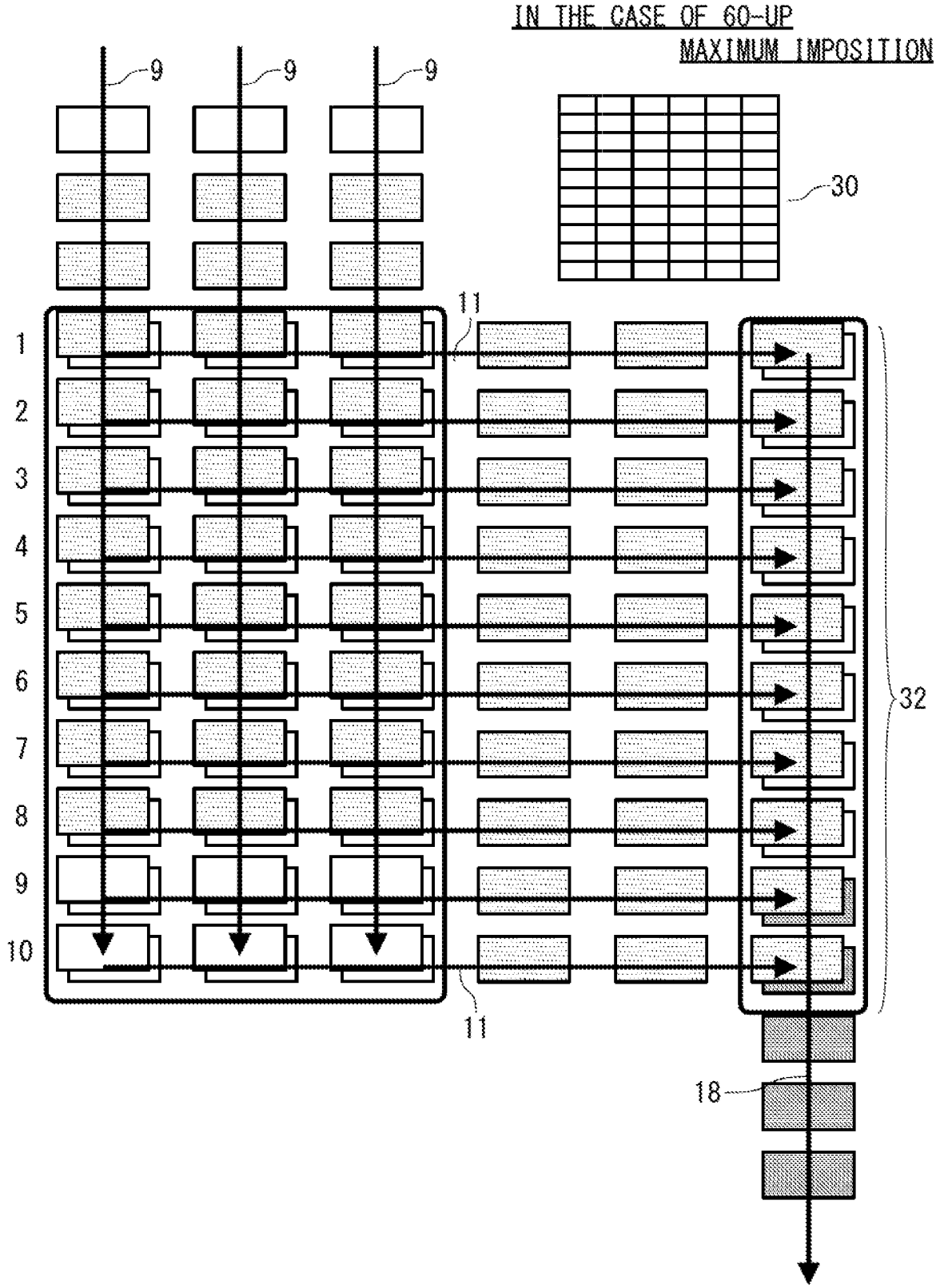
FIG. 8 explains an alignment method employed in the case of a 60-up imposition.
Figure 9:
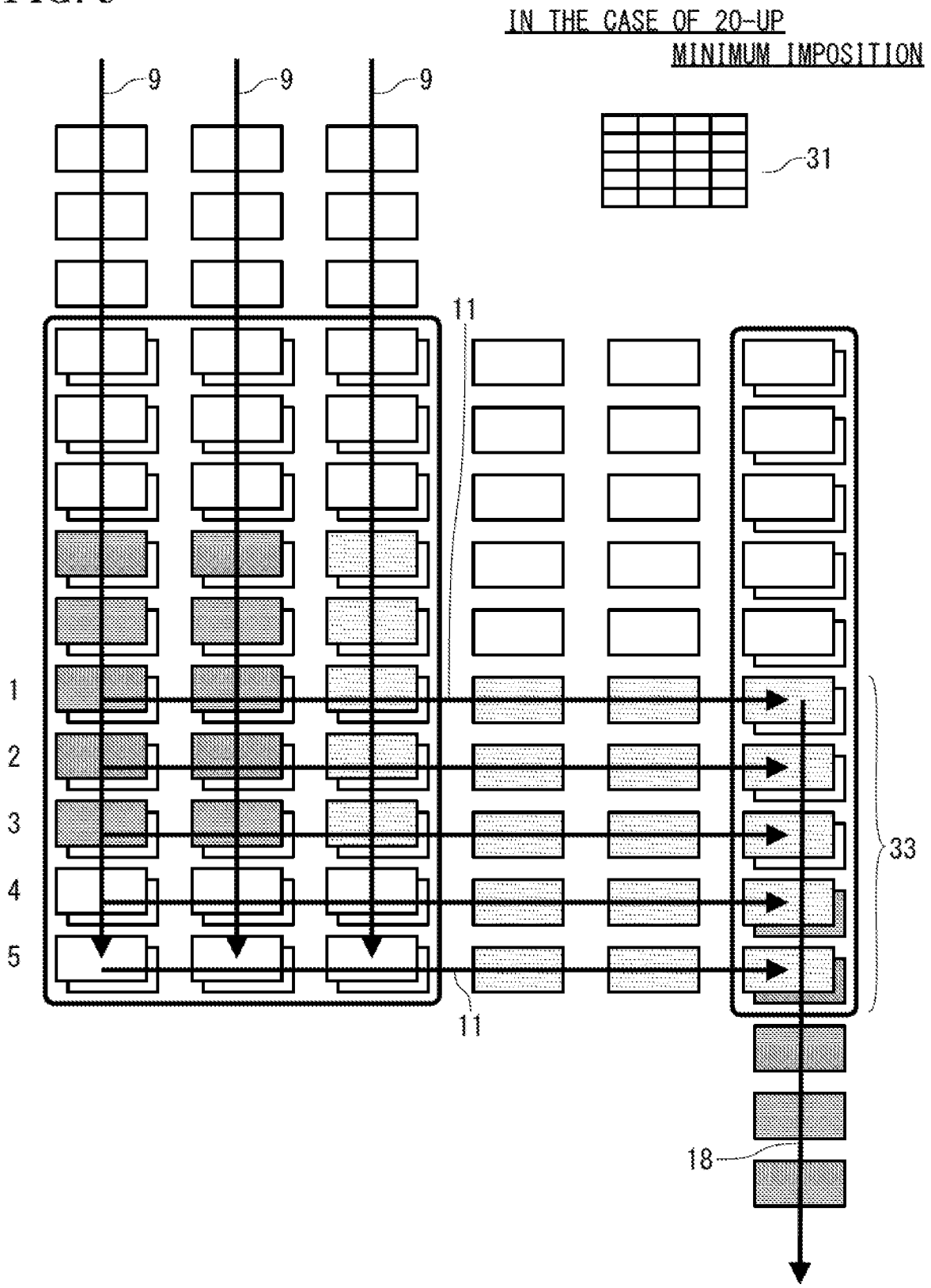
FIG. 9 explains an alignment method employed in the case of a 20-up imposition.

FIG. 8 shows an example using a large sheet block having a 60-up imposition (30) as a maximum imposition structure of this example. FIG. 9 shows an example using a large sheet block having a 20-up imposition (31) as a minimum imposition structure of this example.

The 60-up imposition has 10 layers in each vertical line and six layers in each horizontal line. The 20-up imposition has five layers in each vertical line and four layers in each horizontal line. Unlike the printed unit block aligning device described above, a printed unit block aligning device used herein includes the horizontal feeding and transferring means provided in each of 10 layers.

Three lines from the right end of the large sheet having 60-up imposition are cut in a primary cutting step. Then, a secondary cutting step is performed and resultant bundles are dropped onto the lower rail group. At this time, for transfer from the endless conveyors 11 of the horizontal feeding and transferring means to the endless conveyor 18 of the alignment transferring means, the endless conveyors 11 should travel a distance corresponding to one line at the same speed in a period from when 10 bundles (32) are dropped onto the endless conveyor 18 to when vacancy opens up for next 10 bundles on the endless conveyor 18.

In the case of the large sheet of the 20-up imposition, only five layers of the lower rail group are used to drop five bundles (33) from the endless conveyors 11 onto the endless conveyor 18.

In this structure, unlike the case of the 60-up imposition, the endless conveyors 11 should travel a distance corresponding to one line at the same speed until vacancy opens up for next five bundles on the endless conveyor 18.

As described above, with the different numbers of layers in each vertical line, bundles cannot be transferred to the alignment transferring means successfully unless the speed of the endless conveyors 11 is changed.

In response, in this invention, electrical controlling means (not shown in the drawings) is provided that electrically controls timing of dropping of the printed unit blocks from the supporting means 15 onto the alignment transfer rail 17. While a speed of transfer of the endless conveyors 11 is determined to be uniform for any imposition structure, timing of drop can be changed by the electrical controlling means in a manner that depends on the numbers of layers in each vertical line in different imposition structures.

Figure 10:
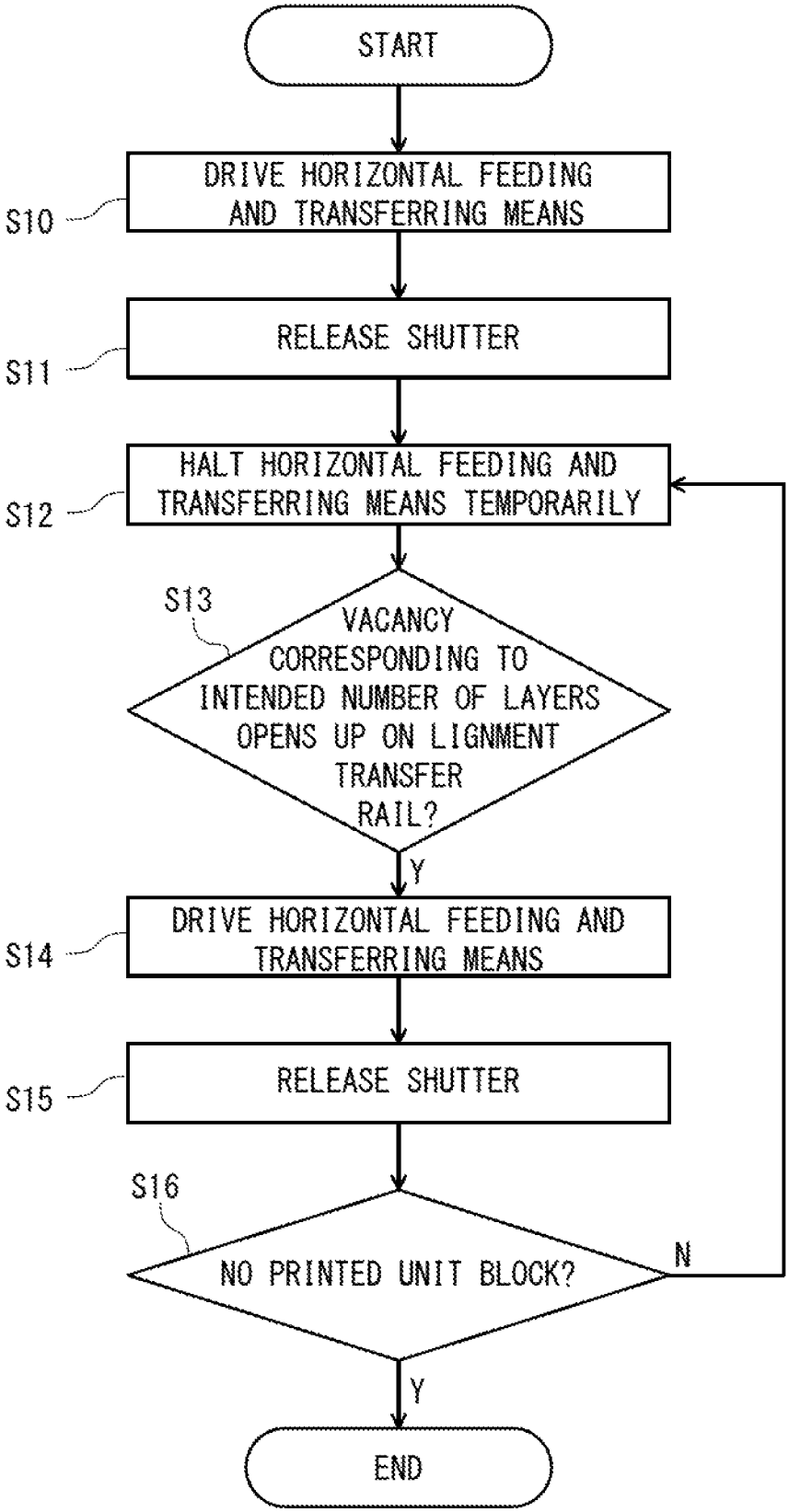
FIG. 10 is a flowchart showing control by electrical controlling means.

FIG. 10 is a flowchart showing control by the electrical controlling means. First, the endless conveyors 11 are driven (S10). The shutter portions 20 of the supporting means 15 are placed at the releasing position (S11) to cause initial drop onto the alignment transfer rail 17.

The electrical controlling means controls a clutch brake 100 provided to the endless conveyors 11 to halt the endless conveyors 11 temporarily (S12), thereby placing the endless conveyors 11 on standby until the aforementioned vacancy for subsequent bundles opens up on the alignment transfer rail 17.

A time of this temporary halt may be determined in advance in a manner that depends on the number of layers. Alternatively, sensor means 21 may be provided to the alignment transfer rail 17 and the halt may continue until vacancy is detected by the sensor means 21.

In compliance with timing of opening up of vacancy corresponding to a desired number of layers (S13), the endless conveyors 11 are driven again (S14) and the shutter portions 20 make releasing operation (S15).

These operations are repeated until all printed unit blocks are aligned (S16).

According to the aforementioned control, while the endless conveyors 11 are caused to travel at a constant speed, imposition structures of different number of layers can be handled freely only by controlling drive and halt of the endless conveyors 11.

It is preferable that the speed of the endless conveyors 11 be unified under a condition of a minimum number of layers in each vertical line of an imposition structure with which the device is compatible. In the aforementioned example, the endless conveyors 11 are required to travel at a highest speed in the case of five layers. In the case of 10 layers, causing the endless conveyors 11 to travel at this speed while halting the endless conveyors 11 achieves continuous transfer to the alignment transferring means.

The number of layers in each vertical line is certainly not limited to the aforementioned numbers. Any number such as six, seven, eight, and nine is applicable.

This example employs the method of controlling the clutch brake of the endless conveyors 11. Alternatively, this invention may employ any method of controlling timing of dropping of the printed unit blocks from the supporting means onto the alignment transfer rail. As an example, this invention may employ a method of directly controlling a drive motor of the endless conveyor or a method of directly controlling timing of opening and closing the shutter portions 20 of the supporting means 15.

REFERENCE SIGNS LIST

1 Large sheet
1' Large sheet block
2 Cutter forming primary cutting means
3 Line unit block
4 Cutter forming secondary cutting means
8 Upper rail
10 Lower rail
15 Block receiving table forming supporting means
17 Alignment transfer rail

The invention claimed is:

1. A printed unit block aligning method of cutting a large sheet with multiple prints having an imposition structure in vertical lines and horizontal lines into printed unit blocks, aligning the printed unit blocks, and transferring the printed unit blocks at a speed constant for any imposition structure to a subsequent step, the method comprising:

a primary cutting step of cutting a large sheet block including a stack of the large sheets into line unit blocks arranged side by side;

a secondary cutting step of cutting the line unit block into printed unit blocks;

a vertically feeding step of feeding a group of the printed unit blocks vertically and charging the printed unit blocks in each line unit block on an upper rail;

a horizontally feeding step of releasing the printed unit blocks from the upper rail, dropping the printed unit blocks onto a lower rail group perpendicular to the upper rail, receiving each of the printed unit blocks in a group in each line unit block, and feeding the group of the printed unit blocks horizontally via horizontal feeding and transferring means; and an alignment transferring step of receiving the group of the printed unit blocks in each line unit block fed horizontally and transferred from the lower rail group with supporting means, releasing the supporting means and making an alignment transfer rail receive the group of the printed unit blocks, aligning the group of the printed unit blocks in each line unit block in a vertical direction, and feeding the group of the printed unit blocks vertically, wherein in the alignment transferring step, electrical controlling means is provided that electrically controls timing of dropping the printed unit blocks from the supporting means onto the alignment transfer rail, and the electrical controlling means controls timing of dropping the printed unit blocks in a manner that depends on a number of layers of the printed unit blocks in each vertical line in different imposition structures while determining a speed of transfer in the horizontal feeding and transferring step to be uniform for any imposition structure;

wherein the alignment transferring step includes an electrical controlling step of controlling a clutch brake provided to the horizontal feeding and transferring means to halt the horizontal feeding temporarily to control timing of dropping the printed unit blocks, thereby placing the horizontal feeding and transferring means on standby until vacancy for a subsequent group of the printed unit blocks opens up on the alignment transfer rail, wherein sensor means is provided to the alignment transfer rail and halting the horizontal feeding continues until vacancy is detected by the sensor means.

2. The printed unit block aligning method according to claim 1, wherein the speed of transfer in the horizontal feeding and transferring step is a speed unified under a condition of a minimum number of layers in each vertical line of an imposition structure.

3. The printed unit block aligning method according to claim 1, wherein the supporting means in a supporting position supports the printed unit block at opposite lateral sides of the printed unit block and the supporting means in a releasing position releases the opposite lateral sides from support by the supporting means simultaneously to drop the printed unit block onto the alignment transfer rail.

4. The printed unit block aligning method according to claim 1, wherein in the electrical controlling step, timing of halting the horizontal feeding temporarily is determined in a manner that depends on a number of layers of the printed unit blocks.

5. The printed unit block aligning method according to claim 4, wherein if vacancy corresponds to a desired number of layers of the printed unit blocks, driving the horizontal feeding and transferring means and releasing the printed unit blocks.

* * * * *